US006822198B2

(12) United States Patent
Rix

(10) Patent No.: US 6,822,198 B2
(45) Date of Patent: Nov. 23, 2004

(54) CONTAINER FOR TRANSPORTING TEMPERATURE SENSITIVE MATERIALS

(75) Inventor: John Robert Rix, South Port (GB)

(73) Assignee: Gorix Limited, South Port (GB)

( * ) Notice: Subject to any disclaimer, the term of this patent is extended or adjusted under 35 U.S.C. 154(b) by 0 days.

(21) Appl. No.: 10/289,500

(22) Filed: Nov. 5, 2002

(65) Prior Publication Data

US 2003/0085215 A1 May 8, 2003

(30) Foreign Application Priority Data

Nov. 6, 2001 (GB) ..... 0128819

(51) Int. Cl.[7] ..... F25B 29/00; F27B 11/00

(52) U.S. Cl. ..... 219/386; 219/201; 165/64; 165/75

(58) Field of Search ..... 219/386, 387, 219/200, 201, 438, 439, 441; 165/58, 61, 64, 75; 206/438

(56) References Cited

U.S. PATENT DOCUMENTS

| | | | | |
|---|---|---|---|---|
| 4,528,439 A | * | 7/1985 | Marney, Jr. et al. | 219/386 |
| 4,543,471 A | * | 9/1985 | Anderson | 219/387 |
| 4,630,671 A | * | 12/1986 | Sherman et al. | 165/61 |
| 5,435,142 A | | 7/1995 | Silber | |
| 6,020,575 A | * | 2/2000 | Nagle et al. | 206/438 |
| 6,229,123 B1 | * | 5/2001 | Kochman et al. | 219/549 |
| 6,452,138 B1 | * | 9/2002 | Kochman et al. | 219/549 |

FOREIGN PATENT DOCUMENTS

| | | | |
|---|---|---|---|
| DE | 29916185 | * | 5/2000 |
| DE | 20008131 | * | 9/2001 |
| GB | 2273762 | * | 6/1994 |
| JP | 2002-62015 | * | 2/2002 |

* cited by examiner

*Primary Examiner*—Joseph Pelham
(74) *Attorney, Agent, or Firm*—Higgs Fletcher & Mack LLP; Charles F. Reidelbach, Jr.

(57) ABSTRACT

A heated transportation container is described. The container consists of at least a body and a lid, the body being generally cuboid and having one or more side walls and a base which together define an internal chamber over which the lid can be placed to close the container. Inside the chamber is disposed a pre-frozen or refrigerated cooling pack to keep the temperature low and in accordance with the invention, a laminar heating, panel is affixed, to at least a portion of the inner surface of one of the side walls and/or to base, said laminar panel comprising an electrically resistive component and electrical connections through which power can be delivered to said laminar panel. Battery powered control circuitry is also provided which communicates with a temperature measuring device disposed within the chamber. In a preferred embodiment, the control circuitry also includes user adjustable means for setting the desired temperature within the chamber and acts to deliver electrical power to the laminar panel to heat same and thus increase the temperature inside the chamber when the temperature measuring means indicates that the temperature is below a desired pre-set or user adjusted temperature.

21 Claims, 2 Drawing Sheets

CONTAINER FOR TRANSPORTING TEMPERATURE SENSITIVE MATERIALS

Figure 1:
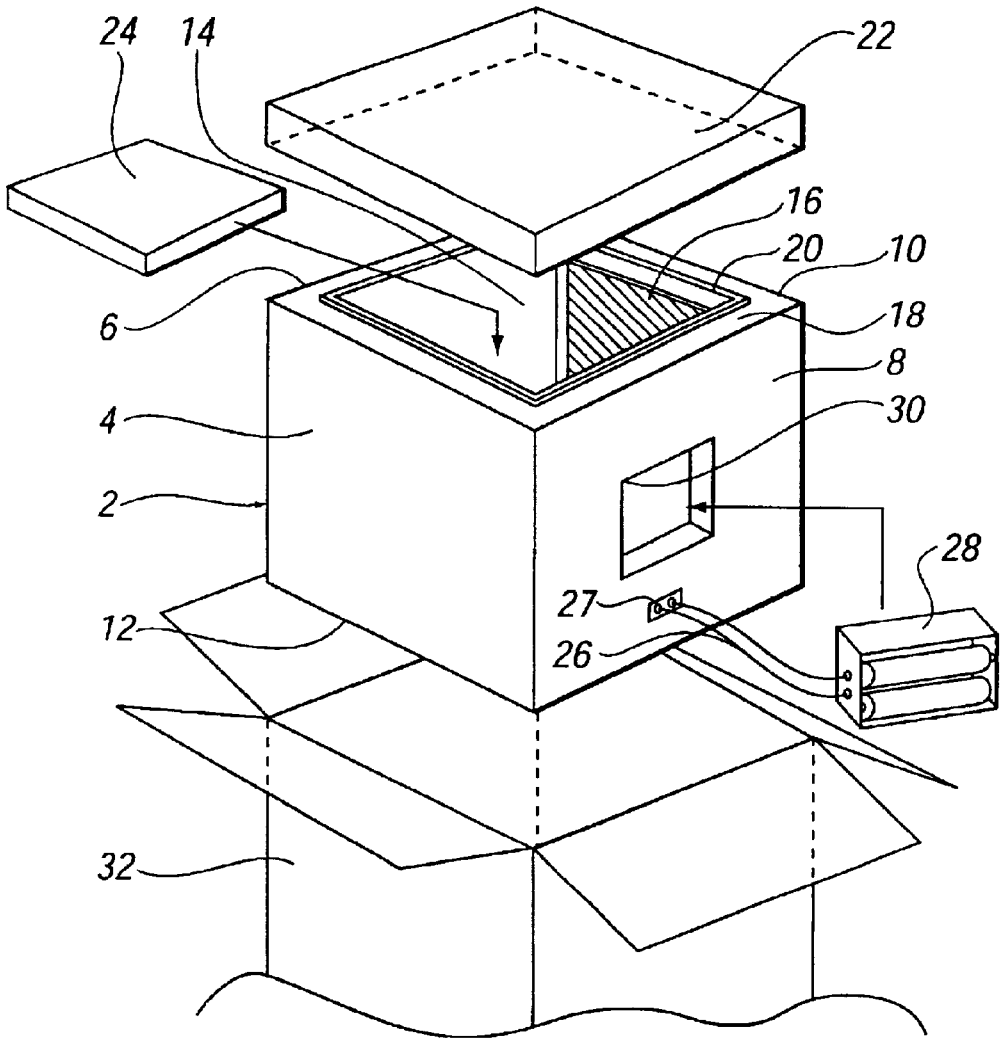

This invention relates to a container for transporting temperature sensitive materials, and more specifically to a container which is adapted to maintain its interior at a desired temperature irrespective of ambient conditions outside the container, whether such conditions be of significantly higher or lower temperature than the desired temperature.

Although the following description relates mainly to the provision of a container for transporting temperature sensitive materials at a temperature which is below that of the normal ambient conditions to which the container may be subjected, it is to be mentioned that the container hereafter described may equally be used to transport materials at a substantially constant temperature which is generally above that of the normal ambient conditions, and the invention should not be considered as limited to either circumstance. Typical examples would include the transportation of temperature sensitive materials, e.g. blood or other biological matter or injectable fluids or solid matter, in typically cold or hot climates, for example in extreme northern or southern countries where temperatures regularly fall below 0° C., or equatorial or tropical countries where the temperatures regularly rise above 25° C. or more.

U.S. Pat. No. 5,435,142 to Silber describes apparatus for packaging temperature sensitive materials for transportation. The apparatus described includes an insulating container which are assembled from a corrugated fibre board carton inside which slab-like foam or polystyrene insulating blocks are disposed to define an inner chamber which completely surrounded by the insulating material. The insulated chamber is capable of holding two frozen bottle style refrigerant packs against its inner lined side wall and two refrigerated brick style refrigerant packs against its top and bottom lined walls to create a cooling chamber within which temperature sensitive materials, also housed in a flexible foam insulation lined container are cooled by a heat transfer cooling mechanism which is capable of maintaining the temperature of the stored materials in the range 2° C. to 10° C. for several hours regardless of the ambient temperatures or conditions exterior to the container.

A fundamental disadvantage of the abovementioned container is that it can operate only in a "passive" manner. Hence, although the container is designed to insulate the interior chamber from the external atmosphere for a predetermined period of time and to maintain the temperature of that interior at a predetermined level for a certain period of time, it is generally impossible to set the desired temperature of the interior at a predetermined level prior to depositing the material into the chamber.

Additionally, although the specification does imply that the temperature of the material stored in the container may be maintained at a level in the range mentioned above for a certain time period, it is not possible to prevent the temperature within the chamber from dropping beneath the lower limit in circumstances where the container is exposed to very low ambient temperatures for significant periods of time. This is often the case in harsh climates where containers of this type are delivered to premises without being received, and the container is merely left outside for later collection. Alternatively, there are instances where containers of this type are transported in vehicles having dedicated refrigeration or freezing compartments for transporting chilled or frozen produce. The difficulty with the transportation of goods in such vehicles is that the temperature of the compartment in which the goods are being transported is usually uniform for all goods contained therein, and therefore unsuitable where the particular material to be transported is particularly sensitive to temperature, for example where deviations from the required transportation temperature of the material can cause significant or immediate degradation of the material.

It is also worth noting that containers which are transported in the cargo holds of aircraft are typically exposed to much lower temperatures, and the container described may be of particular use in these circumstances.

It is therefore an object of the present invention to mitigate against such disadvantages by providing a container within which is defined an insulated inner chamber whose temperature can be accurately set and controlled, and which furthermore is capable of being maintained for long periods of time, particularly where the container is to be used in climates where ambient temperatures are typically very low.

According to the invention there is provided a container consisting of at least a body and a lid, said body having one or more side walls and a base which together define a chamber internally of said body and an opening at one end of said body over which said lid can be disposed to close the chamber, said chamber having therein a pre-frozen or refrigerated cooling pack, characterized in that a laminar panel is affixed to at least a portion of the inner surface of one of the side walls and/or to base, said laminar panel comprising an electrically resistive component and electrical connections through which power can be delivered to said laminar panel to heat same, and further characterized in that battery powered control circuitry is also provided, said control circuitry communicating with temperature measuring means disposed within the chamber that may include user adjustable means for setting the desired temperature within the chamber, said control means acting to deliver electrical power to the laminar panel to heat same and thus increase the temperature inside the chamber when the temperature measuring means indicates that the temperature is below the desired temperature.

In an alternative aspect of the invention, the control circuitry need not be provided with user adjustable means, but instead may be provided with hardwired components which automatically set the desired temperature exactly without the facility for adjustment thereof. Of course in this instance, the container can only be used to store temperature sensitive materials whose condition is maintained substantially unimpaired at the particular temperature dictated by the control circuitry.

Preferably, the container is quadrangular having four sides and a base, and is most preferably square or rectangular.

Ideally, the laminar panel covers at least the whole of one inner surface of one side wall of the chamber, and most preferably a pair of laminar panels having electrically resistive components therein are provided over the inner surfaces of one or two of the side walls of the container.

Preferably the laminar panel comprises an electroconductive textile layer which ensures that the panel can remain thin and does not significantly reduce the volume of the chamber.

Most preferably the control circuitry is disposed within the chamber and proximate the laminar panel, and yet further preferably the electrical connection between the control circuitry and the batteries which power said control circuit and said laminar panel are in the form of wires which pass through one of the walls or the base of the container. Most preferably, the one or more batteries are disposed in a recess formed in the outer surface of one of the walls, base or lid of the container.

It is still further preferable that the container is self contained in that it does not require any external electrical connection for effective operation but is capable of being so connected if so desired.

Most preferably the container, is disposed within a carton board or corrugated cardboard liner.

Figure 2:
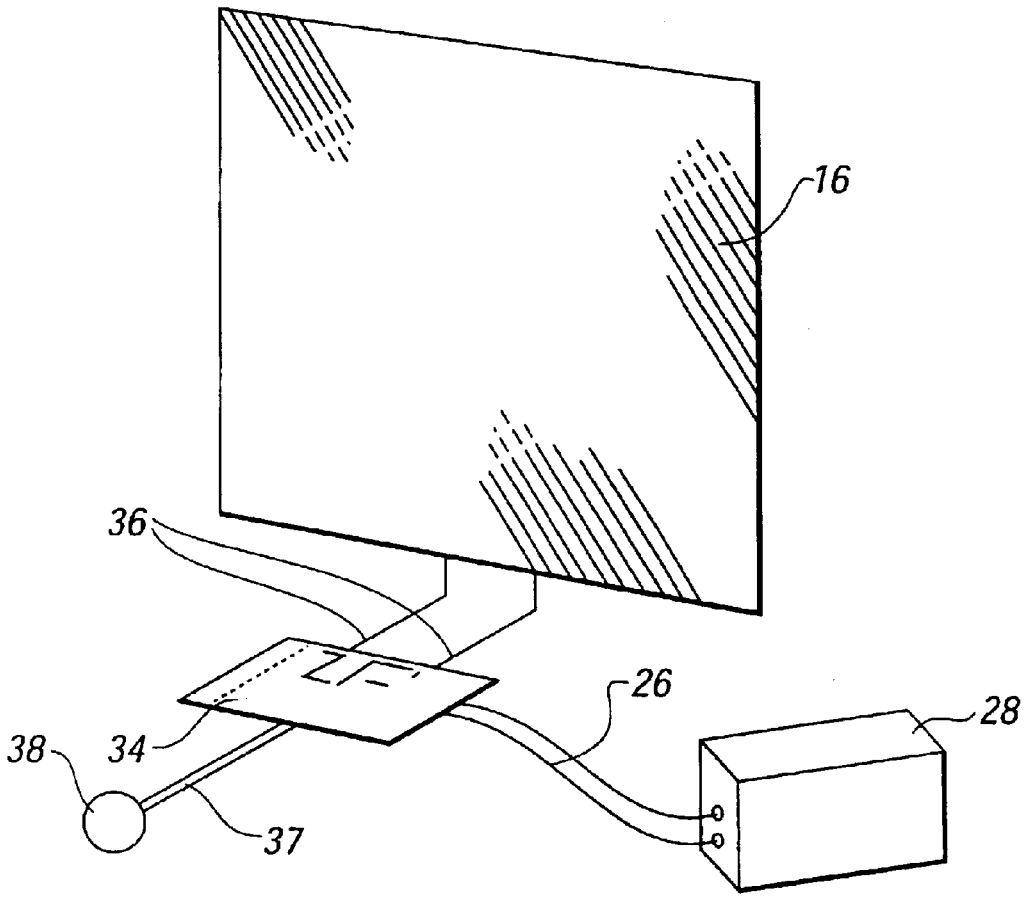

A specific embodiment of the invention is now provided by way of example with reference to the accompanying diagrams:

FIG. 1 shows a perspective view of a container according to the invention, and FIG. 2 shows a perspective view of the laminar panel, control circuitry and battery pack exclusive of the container, and Referring firstly to FIG. 1 there is shown a container 2 according to the invention which is ideally square in cross section and manufactured from a thermally insulating material such as expanded foam or polystyrene. The container has four side walls 4, 6, 8, 10, and a base 12 which together define an interior chamber 14 into which the material to be stored is disposed. On the inner surface of side wall 10 is adhered a laminar heater panel 16 which includes a layer of electro-conductive textile ideally sandwiched between two protective textile layers. The container is provided with an upper edge 18 which defines the opening to the chamber 14 and on said edge is provided a lip 20 with which a corresponding rebate on the underside of a lid 22 engages to seal the chamber.

In accordance with the invention, the container additionally includes a cool pack 24 of the type well known and widely available in the medical industry. Such cool packs typically consist of a sponge soaked in a liquid, or more simply a gel which can be frozen or at least cooled significantly. The liquid or gel will usually be of a thermal heat capacity so that the cool pack can provide a cooling effect for a long period of time.

As can be seen from the figure, electrical wires 26 pass through a suitable aperture 27 in the container side wall and are connected to a battery pack 28. Optionally, said battery pack may be received in a recess 30 provided in a side wall or the base of the container. This embodiment is particularly useful when the container is to be housed within a cardboard liner 32 after the temperature sensitive materials and the cool pack have been deposited inside the chamber, the control circuit has been suitably adjusted and connected and the container has been closed.

Referring now to FIG. 2 there is shown the laminar panel 16 of FIG. 1 connected to control circuitry 34 by wires 36, said control circuitry also being connected to the battery pack 28 by wires 26. It will be understood that the control circuitry may also be disposed externally of the container, perhaps also being recessed in a side wall or base thereof, but in any event it is essential that the control circuitry communicates along wires 37 with temperature sensing means 38 which is disposed within the chamber for monitoring the temperature therewithin.

In terms of the control circuitry which may be used to control the operation of the laminar heating panel, conventional electronic technique may be employed to develop thermostatic control of the temperature of the chamber. For example, a rotary potentiaometer may be used to provide the user adjustability and to enable the user to select a desired chamber temperature. A "trimmer" component may be used in order that the temperature is fully variable in a particular range.

Typically, such control circuitry will be provided with a voltage in the range of 4.5V–24V and/or vehicle supply, which can easily be obtained from conventional battery power.

As regards other modification to the invention which may be considered, the following are important.

In a situation where the temperature never falls sufficiently low for the control circuitry to cause the heating of the laminar panel then the cooling pack would maintain a sufficiently low temperature for the contents of the box to remain viable until delivery is effected.

The battery pack powering the control circuit axed laminar panel could be of a type particularly suited to air transportation as a possible use for the container may be the rapid air transportation of donor organs en-route to transplant surgery. Alternatively the container may be used for temperature controlled delivery of high value or temperature critical food products.

The container could be constructed of materials capable of undergoing sterilization and hence become re-useable to such an extent that a deposit and refund scheme could be constructed to capitalize on the cost of each unit, effectively amortizing the cost of the units over several. transportations.

The colouration of the outer surface of either the container or the liner or both could be either very dark to render it thermally absorbent in low temperatures or light in colour to make it thermally reflective in high temperatures. A convenient carrying handle or similar assembly may be provided, in the liner or the container to aid straight and level carriage of the container thus ensuring minimal disturbance to the temperature sensitive materials inside the chamber which may also be movement critical. The arrangement of the opening flaps of the box would be made in such a way as to ensure the speedy opening of the box and the rapid recovery of the contents once delivery has been effected. The outer surface of the container could be printed with instructional information on how the system functions and what steps must be taken to ensure safe and viable transit of the contents. Such instructions could be printed in day glow or luminescent inks so that the instructions could be read during low light conditions.

Where the temperature of the contents of the box is critical, a temperature readout device could be placed on the outer surface of the box to constantly display the temperature of the contents to delivery personnel. Additionally a low battery warning display could be similarly externally mounted to alert delivery personnel to change a failing battery pack access to which may be gained via a suitably constructed door arrangement contained on the outer surface of the liner. Such warning delivery system may be audible as an alternative to visual signals so as to alert delivery personnel during periods of low light conditions.

What is claimed is:

1. A container consisting of at least a body and a lid, said body having one or more side walls and a base which together define a chamber internally of said body and an opening at one end of said body over which said lid can be disposed to close the chamber, said chamber having therein a cooling pack, characterized in that a laminar panel is affixed to at least a portion of the inner surface of said body, said laminar panel comprising an electrically resistive component and electrical connections through which power can be delivered to said laminar panel for heating thereof and wherein the container is disposed within a board liner.

2. A container according to claim 1 further characterized in that battery powered control circuitry is also provided, said control circuitry communicating with temperature measuring means disposed within the chamber, said control circuitry also including user adjustable means for setting the desired temperature within the chamber, said control means acting to deliver electrical power to the laminar panel to heat same and thus increase the temperature inside the chamber when the temperature measuring means indicates that the temperature is below the desired temperature.

3. A container according to claim 1 further characterized in that battery powered control circuitry is also provided, said control circuitry communicating with temperature measuring means disposed within the chamber and acting to deliver electrical power to the laminar panel to heat same and thus increase the temperature inside the chamber when the temperature measuring means indicates that the temperature is below a desired, pre-set temperature.

4. A container according to claim 1 characterized in that said container is quadrangular having four sides and a base.

5. A container according to claim 1 characterized in that the laminar panel covers at least the whole of one inner surface of one side wall of the chamber.

6. A container according to claim 1 characterized in that a pair of laminar panels having electrically resistive components therein are provided over at least one of the inner surfaces of the side walls of the container and one other inner surface of said container.

7. A container according to claim 1 characterized in that the laminar panel comprises an electro-conductive textile layer which ensures that the panel can remain thin and does not significantly reduce the volume of the chamber.

8. A container according to claim 2 characterized in that the control circuitry is disposed within the chamber and proximate the laminar panel.

9. A container according to claim 8 characterized in that the electrical connection between the control circuitry and the batteries which power said control circuit and said laminar panel are in the form, of wires which pass through one of the walls of the container.

10. A container according to claim 9 characterized in that the one or more batteries are disposed in a recess formed in the outer surface of one of the walls of the container.

11. A container according to claim 1 characterized in that the container is self contained in that it does not require any external electrical connection for effective operation but is capable of being so connected if so desired.

12. A container according to claim 1 characterized in that the container is disposed within a corrugated cardboard liner.

13. A container according to claim 9 characterized in that the one or more batteries are disposed in a recess formed in the outer surface of the base of the container.

14. A container according to claim 9 characterized in that the one or more batteries are disposed in a recess formed in the outer surface of the lid of the container.

15. A container according to claim 8 characterized in that the electrical connection between the control circuitry and the batteries which power said control circuit and said laminar panel are in the form, of wires which pass through the base of the container.

16. A container according to claim 1 wherein said laminar panel is affixed to at least a portion of the inner surface of one of the side walls.

17. A container according to claim 1 wherein said laminar panel is affixed to at least a portion of the base.

18. A container according to claim 1 wherein said cooling pack is a refrigerated cooling pack.

19. A container according to claim 1 wherein said cooling pack is a pre-frozen cooling pack.

20. A container according to claim 4 wherein said container is square.

21. A container according to claim 4 wherein said container is rectangular.

* * * * *